US007597966B2

(12) United States Patent
Spitsberg et al.

(10) Patent No.: US 7,597,966 B2
(45) Date of Patent: Oct. 6, 2009

(54) THERMAL BARRIER COATING AND PROCESS THEREFOR

(75) Inventors: Irene Spitsberg, Loveland, OH (US); Brett Allen Rohrer Boutwell, Liberty Township, OH (US); Robert William Bruce, Loveland, OH (US); Curtis Alan Johnson, Niskayuna, NY (US); Bangalore Aswatha Nagaraj, West Chester, OH (US); William Scott Walston, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 484 days.

(21) Appl. No.: 11/160,164

(22) Filed: Jun. 10, 2005

(65) Prior Publication Data

US 2006/0280926 A1 Dec. 14, 2006

(51) Int. Cl.
*B32B 9/00* (2006.01)

(52) U.S. Cl. ..... 428/469; 428/472; 428/701; 428/702; 416/241 B; 416/241 R

(58) Field of Classification Search ..... None
See application file for complete search history.

(56) References Cited

U.S. PATENT DOCUMENTS

| | | | | |
|---|---|---|---|---|
| 4,916,022 | A | 4/1990 | Solfest et al. | 428/623 |
| 5,683,825 | A | 11/1997 | Bruce et al. | 428/698 |
| 5,981,088 | A | 11/1999 | Bruce et al. | |
| 6,127,006 | A | 10/2000 | Schulz et al. | 427/585 |
| 6,333,090 | B1 | 12/2001 | Schulz et al. | 428/92 |
| 6,342,278 | B1 | 1/2002 | Rigney et al. | 427/567 |
| 6,599,568 | B2 | 7/2003 | Lee et al. | 427/230 |
| 6,627,323 | B2 | 9/2003 | Nagaraj et al. | 428/469 |
| 6,869,703 | B1 | 3/2005 | Spitsberg et al. | |
| 6,875,529 | B1 | 4/2005 | Spitsberg et al. | 428/701 |
| 7,318,955 | B2 * | 1/2008 | Darolia et al. | 428/141 |
| 2002/0110698 | A1 | 8/2002 | Singh | |
| 2003/0224200 | A1 | 12/2003 | Bruce | |
| 2005/0112412 | A1 | 5/2005 | Darolia et al. | 428/702 |
| 2005/0129972 | A1 | 6/2005 | Matsumoto et al. | |
| 2006/0019119 | A1 | 1/2006 | Spitsberg et al. | |

FOREIGN PATENT DOCUMENTS

| | | |
|---|---|---|
| EP | 0605196 | 7/1994 |

* cited by examiner

*Primary Examiner*—Timothy M Speer
(74) *Attorney, Agent, or Firm*—William Scott Andes; Gary M. Hartman; Domenica N. S. Hartman

(57) ABSTRACT

A thermal barrier coating and deposition process for a component intended for use in a hostile thermal environment, such as the turbine, combustor and augmentor components of a gas turbine engine. The TBC has a first coating portion on at least a first surface portion of the component. The first coating portion is formed of a ceramic material to have at least an inner region, at least an outer region overlying the inner region, and a columnar microstructure whereby the inner and outer regions comprise columns of the ceramic material. The columns of the inner region are more closely spaced than the columns of the outer region so that the inner region of the first coating portion is denser than the outer region of the first coating portion, wherein the higher density of the inner region promotes the impact resistance of the first coating portion.

15 Claims, 2 Drawing Sheets

THERMAL BARRIER COATING AND PROCESS THEREFOR

This invention was made with Government support under Agreement No. N00019-96-C-0176. The Govemment has certain rights in the invention.

BACKGROUND OF THE INVENTION

This invention generally relates to coatings for components exposed to high temperatures, such as the hostile thermal environment of a gas turbine engine. More particularly, this invention is directed to a thermal barrier coating (TBC) deposited on a surface to have a columnar microstructure, wherein the TBC overlying at least certain portions of the surface has an interior region that is denser than an exterior region overlying the interior region to improve the impact resistance of the TBC.

Components within the hot gas path of gas turbine engines are often protected by TBC's that are typically formed of ceramic materials deposited by plasma spraying, flame spraying, and physical vapor deposition (PVD) techniques. TBC's employed in the highest temperature regions of gas turbine engines are most often deposited by PVD, particularly electron-beam PVD (EBPVD), which yields a strain-tolerant columnar grain structure that is able to expand and contract without causing damaging stresses that lead to spallation. Similar columnar microstructures can also be produced using other atomic and molecular vapor processes, such as sputtering (e.g., high and low pressure, standard or collimated plume), ion plasma deposition, and all forms of melting and evaporation deposition processes (e.g., laser melting, etc.).

Various ceramic materials have been proposed as TBC's, the most widely used being zirconia ($ZrO_2$) partially or fully stabilized by yttria ($Y_2O_3$), magnesia (MgO), or ceria ($CeO_2$) to yield a tetragonal microstructure that resists phase changes. Though various other stabilizers have been proposed for zirconia, yttria-stabilized zirconia (YSZ) is often preferred due at least in part to its high temperature capability, low thermal conductivity, and relative ease of deposition by plasma spraying, flame spraying, and PVD techniques. Nonetheless, considerable effort has been made to formulate ceramic materials with reduced thermal conductivity, improved resistance to spallation and sintering, and other properties and characteristics that detrimentally affect the thermal insulating capability of a TBC.

In addition to low thermal conductivity and spallation resistance, TBC's on gas turbine engine components are required to withstand damage from erosion and impact by particles of varying sizes that are generated upstream in the engine or enter the high velocity gas stream through the air intake of a gas turbine engine. The damage can be in the form of erosive wear (generally from smaller particles, lower particle velocities, and/or lower impingement angles) and impact spallation (generally from larger particles, greater particle velocities, and/or greater impingement angles). Commonly-assigned U.S. Pat. No. 5,981,088 to Bruce et al. teaches that YSZ containing less than six weight percent yttria exhibits improved impact resistance. In addition, commonly-assigned U.S. Pat. No. 6,352,788 to Bruce and U.S. Pat. No. 7,060,365 to Bruce teach that small additions of oxides such as magnesia, hafnia, lanthana, neodymia, and/or tantala can improve the impact and erosion resistance of zirconia partially stabilized by about four weight percent yttria (4%YSZ). Aside from compositional approaches, improvements in erosion and impact resistance have been achieved by forming the outer region of a PVD TBC to be denser than an underlying interior region of the TBC, as taught in commonly-assigned U.S. Pat. No. 5,683,825 to Bruce et al. and commonly-assigned U.S. Pat. No. 6,982,126 to Darolia et al.

Notwithstanding the above-noted advancements, it would be desirable if TBC's were available that exhibited further improvements in resistance to particle damage, and particularly impact damage.

BRIEF SUMMARY OF THE INVENTION

The present invention generally provides a TBC and deposition process for a component intended for use in a hostile thermal environment, such as the turbine, combustor and augmentor components of a gas turbine engine. The TBC has a first coating portion on at least a first surface portion of the component. The first coating portion is formed of a ceramic material to have at least an inner region, at least an outer region overlying the inner region, and a columnar microstructure whereby the inner and outer regions comprise columns of the ceramic material. The columns of the inner region are more closely spaced than the columns of the outer region so that the inner region of the first coating portion is denser than the outer region of the first coating portion. According to a preferred aspect of the invention, the higher density of the inner region promotes the impact resistance of the first coating portion.

The TBC and process of this invention allow for the TBC to have a second coating portion on a second surface portion of the component. The second coating portion can be formed to have a columnar microstructure of the same ceramic material as the first coating portion, but with a denser outer region overlying a less dense inner region. For example, the inner region of the second coating portion can be deposited to be similar to the outer region of the first coating portion, while the outer region of the second coating portion can be deposited to be similar to the inner region of the first coating portion. With this embodiment, the inner region of the second coating portion can be simultaneously deposited with the outer region of the first coating portion so as to be a continuum thereof. With this approach, the first coating portion is capable of being more impact resistant than the second coating portion, while the second coating portion is more erosion resistant than the first coating portion.

The TBC and process of this invention also allow for the TBC to have a third coating portion on a third surface portion of the component, with the third coating portion being formed of the ceramic material but thinner than the first and second coating portions. For example, the entire third coating portion can be deposited during the simultaneous deposition of the outer region of the first coating portion and the inner region of the second coating portion. With this approach, the third coating portion can be deposited on less critical surface regions of the component and/or on those surfaces that are less prone to impact and erosion damage, thereby minimizing the weight of the TBC.

From the above, it can be appreciated that the present invention enables a TBC deposited on a component to be tailored to have different coating portions with different levels of erosion and impact resistance based on the location of a denser coating region within the different coating portions. As such, the TBC can be deposited so that certain surface portions more prone to impact damage are made more impact resistant due to the presence of a denser inner coating region, while other surface portions more prone to erosion damage are made more erosion resistant due to the presence of a denser outer coating region. The TBC can be deposited by PVD techniques to obtain the desired strain-resistant columnar grain structure noted above, with the closer column spacing of the outer surface region being achievable through compositional or processing modifications.

Other objects and advantages of this invention will be better appreciated from the following detailed description.

DETAILED DESCRIPTION OF THE INVENTION

Figure 1:
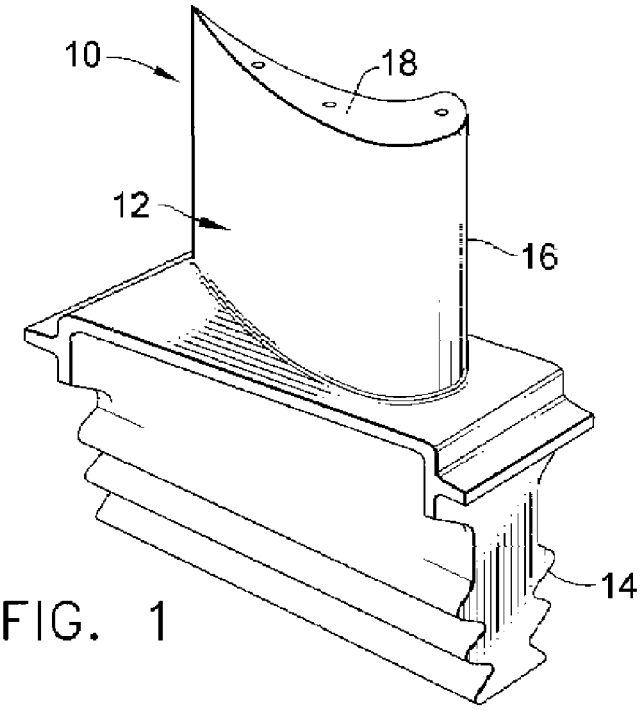
FIG. 1 is a perspective view of a high pressure turbine blade.

While the present invention is applicable to a variety of components subjected to high temperatures, such as the high and low pressure turbine nozzles and blades, shrouds, centerbodies, combustor liners, and deflectors of gas turbine engines, the invention will be discussed in reference to a high pressure turbine (HPT) blade 10 shown in FIG. 1. The blade 10 generally includes an airfoil 12 against which hot combustion gases are directed during operation of the gas turbine engine, and whose surfaces are therefore subjected to heat, oxidation, and corrosion from the combustion gases as well as impact and erosion damage from particles entrained in the combustion gases. The airfoil 12 is shown as being configured for anchoring to a turbine disk (not shown) with a dovetail 14. For purposes of the following description, the leading edge 16 and the concave (pressure) surface 18 of the airfoil 12 are also identified in FIG. 1.

Figure 2:
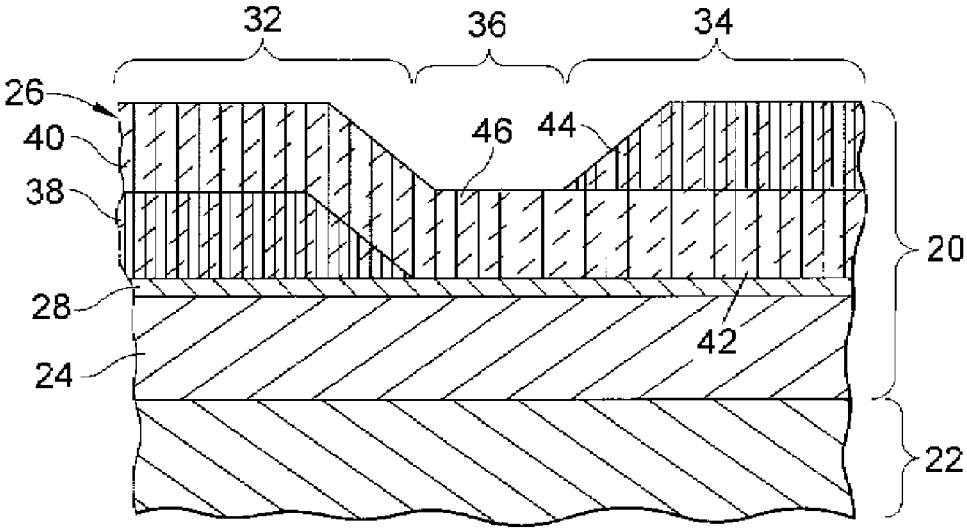
FIG. 2 schematically represents a cross-sectional view of the blade of FIG. 1 along line 2-2, and shows a thermal barrier coating system on the blade with three coating portions in accordance with an embodiment of the invention.

To protect the airfoil 12 from its hostile operating environment, at least the surfaces of the airfoil 12 are proved with a thermal barrier coating (TBC) system 20, which is schematically depicted in FIG. 2 in accordance with the present invention. The TBC system 20 is represented in FIG. 2 as including a multilayer ceramic TBC 26 anchored with a metallic bond coat 24 to a surface region 22 of the airfoil 12, which is usually a nickel, cobalt, or iron-based superalloy. As is typical with TBC systems for components of gas turbine engines, the bond coat 24 is preferably an aluminum-rich composition of a type known in the art, such as an overlay coating of a beta-phase NiAl intermetallic or an MCrAlX alloy, or a diffusion coating such as a diffusion aluminide or a diffusion platinum aluminide. As such, the bond coat 24 develops an aluminum oxide (alumina) scale 28 as a result of oxidation, such as during deposition of the TBC 26 on the bond coat 24, as well as high temperature excursions of the blade 10 during engine operation. The alumina scale 28 chemically bonds the TBC 26 to the bond coat 24 and substrate 22. The TBC 26 is represented in FIG. 2 as having a strain-tolerant microstructure of columnar grains. As known in the art, such columnar microstructures can be achieved by depositing the TBC 26 using a physical vapor deposition technique, such as EBPVD or another atomic and molecular vapor process, as well as known melting and evaporation deposition processes. As with prior art TBC's, the TBC 26 is deposited to a thickness that is sufficient to provide the required thermal protection for the underlying surface region 22 of the airfoil 12.

The TBC 26 is depicted in FIG. 2 as having three coating portions 32, 34, and 36 overlying different surface areas of the surface region 22. A first coating portion 32 is shown made up two layers that form inner and outer regions 38 and 40 of the coating portion 32, the latter of which also forms the outer surface of the TBC 26. A second coating portion 34 is also shown as being made up two layers, in which the layer forming an inner region 42 of the coating portion 34 is a continuum of the layer forming the outer region 40 of the first coating portion 32. Between the first and second coating portions 32 and 34 is a third coating portion 36 primarily formed by a single layer that is a continuum of the outer region 40 of the first coating portion 32 and the inner region 42 of the second coating portion 34. It should be understood that FIG. 2 is merely intended to help explain the invention, and that the proportions of the coating portions 32, 34, and 36 and the transitions therebetween are not intended to limit or define the invention in any way. For example, in practice the coating portion 36 can cover a much larger surface area than the coating portions 32 and 34, and the transitions are likely to be much more gradual and possibly irregular as compared to what is represented in FIG. 2.

The columnar grains of the layers forming the inner region 38 of the first coating portion 32 and the outer region 44 of the second coating portion 34 are represented as being more closely spaced than the grains of the layer forming the outer region 40 of the first coating portion 32, the inner region 42 of the second coating portion 34, and the third coating portion 36, with the result that the TBC 26 is more porous within the outer region 40 of the first coating portion 32 and the inner region 42 of the second coating portion 34. Consequently, the first coating portion 32 has a denser inner region 38 and the second coating portion 34 has a denser outer region 42. While the denser outer region 42 of the second coating portion 34 promotes the erosion resistance of the second coating portion 34 in accordance with, for example, commonly-assigned U.S. Pat. No. 5,683,825 and U.S. Pat. No. 6,982,126, the denser inner region 38 of the first coating portion 32 is believed to promote the impact resistance of the first coating portion 32. To promote the impact resistance of the denser inner region 38 and the erosion resistance of the denser outer region 44, the columns within the separate layers forming these regions 38 and 44 should be sufficiently dense to yield a porosity of less than 20 percent by volume, preferably 15 percent or less by volume, while the columns within the layer forming the remaining regions 40, 42, and 46 can have a porosity of greater than 20 percent by volume in order to minimize the thermal conductivity of the TBC 26 within these regions 40, 42, and 46.

As will be discussed below, it is believed that the denser inner region 38 is capable of promoting the impact resistance of the first coating portion 32 as a result of the failure mode by which spallation from impact damage occurs. Specifically, whereas damage from erosion occurs by the gradual removal of thin layers from the surface of a TBC, spallation from impact damage has been observed to initiate within the innermost portions of TBC's, generally in the vicinity of the interface between the TBC and its bond coat. Forming the inner region 38 of a denser columnar microstructure is believed to increase the fracture toughness of the inner region 38, thereby raising the threshold required to initiate cracking and slowing the propagation of cracks that inevitably form.

Further improvements in fracture toughness is also believed to be obtainable by forming the inner region 38 of the first coating portion 32 to have the crystallographic texture [100], in which the columnar grains grow in a textured manner in the [100]. The advantage is believed to follow from the higher fracture toughness of tetragonal zirconia associated with such texture, as compared with the typically observed texture [111] or random orientation of TBC's. Improved resistance to crack propagation within the inner region 38 can also be achieved by grooving the surface of the bond coat 24 prior to depositing the TBC 26, such as in accordance with commonly-assigned U.S. Pat. No. 5,419,971 to Skelly et al. In the context of the present invention, grooving is believed to slow the propagation of cracks that are caused by thermal fatigue and tend to propagate at or just above the TBC-bond coat interface.

By combining the different microstructures of the inner and outer regions 38, 40, 42, and 44 into a TBC 26 as represented in FIG. 2, improved impact resistance can be achieved in selected surface areas of the blade 10 and improved erosion resistance can be simultaneously achieved on other surface areas of the blade 10, while maintaining thermal protection of these and the remaining surface areas of the blade 10. With particular reference to the blade 10, such a TBC 26 can be deposited so that the more impact-resistant coating portion 32 is deposited on those areas most prone to damage from impact, such as the leading edge 16 of the airfoil 12, and the more erosion-resistant coating portion 34 can be deposited on those areas most prone to erosion damage, such as the concave (pressure) surface 18 of the airfoil 12. The remaining surfaces of the airfoil 12 requiring thermal protection can be coated with the coating portion 36, which has minimum thickness as a result of lacking the denser coating regions 38 and 44. Such an approach has the advantage of improving impact and erosion resistance of the blade 10 with minimal increase in blade weight attributable to the TBC 26. Additionally, the dense, fracture-resistant microstructure of the inner region 38 on the leading edge 16 will result in improved performance and durability of the blade 10 and its TBC 26 beyond what could be achieved by simply increasing the thickness of a conventional TBC, while avoiding the additional weight that would be incurred with such an approach.

As evident from FIG. 2, the thickness of the TBC 26 within the first and second coating portions 32 and 34 is greater than within the third coating portion 36, which is advantageous since the first and second coating portions 32 and 34 are intended to be applied where damage from particle impact and/or erosion is more likely. Generally, the maximum thickness of the TBC 26 can be in a range of about 50 to about 325 micrometers, with the thicknesses of the coating portions 32 and 34 being about two to about five mils (about 50 to about 125 micrometers) greater than the third coating portion 36. It is believed that the dense inner region 38 of the first coating portion 32 and the dense outer region 44 of the second coating portion 34 should constitute up to about half the thickness of the TBC 26 within their respective coating regions 32 and 34, for example, about 0.3 to about three mils (about 7.5 to about 75 micrometers) in thickness, more preferably about 0.5 to about 1 mil (about 12 to about 25 micrometers) in thickness. The inner and outer regions 38, 40, 42, and 44 are illustrated in FIG. 2 as being somewhat distinct, though it is within the scope of the invention that the transition between the porous to denser microstructures can be gradual or more distinct.

While the TBC 26 is depicted in FIG. 2 as containing not more than two layers over any given area of the surface region 22, the TBC 26 can comprise any number of alternating dense and porous interior layers between the inner regions 38 and 42 and their respective outer regions 40 and 44, with these dense and porous interior layers having microstructures similar to the dense regions 38 and 44 and porous regions 40 and 42, respectively. The denser of such interior layers preferably have thicknesses of up to about 0.5 mil (about 12 micrometers), and are preferably spaced apart by the porous layers whose thicknesses are about 0.5 to 2 mils (about 12 to 50 micrometers). With a combination of denser and porous interior layers within the TBC 26, improvements in both impact resistance and erosion resistance can be obtained in a single region of the TBC 26.

A suitable ceramic material for the TBC 26 is YSZ, though it is foreseeable that various other ceramic materials proposed for TBC's could be used instead, as well as different ceramic materials for the layers forming the regions 38, 40, 42, 44, and 46. According to one embodiment, the entire TBC 26 is formed of YSZ, such as about 6-8% YSZ (zirconia stabilized with about six to about eight weight percent yttria). Alternatively, the denser regions 38 and 44 can be formed of the impact-resistant YSZ compositions taught in U.S. Pat. No. 5,981,088 to Bruce et al., U.S. Pat. No. 6,352,788 to Bruce, and U.S. patent application Ser. No. 10/063,962 to Bruce. By maintaining a substantially constant composition through the thickness of the TBC 26, the formation of interfaces that could serve as paths for crack propagation through the TBC 26 is minimized or avoided.

Various process and composition-related approaches can be used to obtain the different microstructures within the regions 38, 40, 42, 44, and 46 of the TBC 26, as will be discussed below. As noted above, the compositions of the regions 38, 40, 42, 44, and 46 may be identical (resulting in a constant composition throughout the TBC 26), have the same base composition but modified with certain additions, or have different base compositions. If the regions 38, 40, 42, 44, and 46 have the same composition, processing modifications must be made to result in the denser microstructures desired for the regions 38 and 44. If the regions 38, 40, 42, 44, and 46 have the same base composition, minor chemistry modifications can be made to the denser regions 38 and 44 to enhance surface diffusion processes and promote flatness of the crystallization front, causing a majority of the inter-columnar gaps to decrease during deposition by PVD. Examples of such chemistry modifications include additions of nickel, titanium, chromium, and/or their oxides to enhance sintering processes in zirconia during deposition of the dense regions 38 and 44.

A process suitable for achieving the TBC 26 of the type represented in FIG. 2 with only modifications to an otherwise conventional EBPVD process can be achieved as follows. Deposition is initiated on the blade 10 with the blade 10 held stationary and its leading edge 16 facing the molten pool of ceramic material (e.g., YSZ) being evaporated with an electron gun. Deposition in this manner continues until the desired thickness for the inner region 38 has been deposited on the leading edge 16. Alternatively, the blade 10 can undergo slow and/or limited oscillation as needed to control and increase the density of the deposited ceramic. Thereafter, a typical rotation pattern can be initiated while deposition continues to deposit the ceramic that forms the more porous regions 40, 42, and 46 of the TBC 26 over the entire airfoil 12. Once the desired thickness for these regions 40, 42, and 46 has been obtained, rotation is stopped to position the blade 10 with its concave surface 18 facing the molten pool to deposit the dense outer region 44 on only the concave surface 18. As before, the blade 10 may be held stationary or undergo a limited and/or slow oscillation to increase the density of the deposited ceramic. To deposit the interior regions of alternating dense and porous regions described above, rotation of the blade 10 can be periodically stopped during that part of the deposition process following deposition of the inner layer 38 on the leading edge 16 and before deposition of the outer layer 44 on the concave surface 18. To create the [100] texture in the dense inner region 38 on the leading edge 16, additional variation of process parameters may be required. It is believed that the [100] texture can be achieved with a combination of stationary deposition and increasing the deposition temperature, such as by generating additional heat with a second electron beam gun during deposition on the leading edge 16.

In investigations leading to this invention, YSZ TBC's having a nominal yttria content of about seven weight percent were deposited by EBPVD to have thicknesses of about 125 micrometers. Each of the TBC's were deposited on pin specimens formed of René N5 (nominal composition of, by weight, about 7.5% Co, 7.0% Cr, 6.5% Ta, 6.2% Al, 5.0% W, 3.0% Re, 1.5% Mo, 0.15% Hf, 0.05% C, 0.004% B, 0.01% Y, the balance nickel and incidental impurities), on which a platinum aluminide (PtAl) bond coat had been previously deposited. The microstructures of the TBC's differed from each other as a result of modifications to the EBPVD process. Specifically, a baseline group of pins were coated using a deposition pressure of about 12 microbars, while two additional sets of pins were coated at a lower rate as a result of being coated at a deposition pressure of 5 microbars in an oxygen-containing atmosphere or an argon atmosphere. Following deposition, the porosities of the TBC's were determined to be about 24 to about 30 percent by volume for the baseline pins, about 17 percent by volume for the pins coated in the oxygen atmosphere at 5 microbars, and about 19 percent by volume for the pins coated in the argon atmosphere at 5 microbars.

The impact performance of these specimens was assessed by cycling the coated pins in and out of a jet stream into which alumina particulate was injected. Coating loss was then correlated to the mass of the particulate required to wear through (spall) the TBC. The results were normalized to the coating thickness and recorded in grams of particulate per one mil (25 micrometers) of coating thickness (g/mil) to permit comparison between coatings of different thicknesses. The results were as follows: about 70 to about 110 g/mil for TBC's with densities of about 24 to 30%, about 170 to about 190 g/mil for TBC's with densities of about 17%, and about 160 to about 180 g/mil for TBC's with densities of about 19%. These results demonstrated that improved impact resistance can be achieved with 7% YSZ by increasing the density of the columnar microstructure. While increased density was achieved by varying the deposition pressure, similar increases in density and impact resistance should be attainable by depositing TBC on a substrate held stationary or slowly rotated or oscillated as described previously.

Further analysis conducted to investigate the present invention also demonstrated that the erosion and impact behavior of TBC is determined at least in part by overall porosity levels and the stability of the zirconia lattice. The analysis was performed with more than fifty experimental data points for erosion and impact performance obtained from coatings having various different compositions deposited by EBPVD, including 7% YSZ, 4% YSZ, YSZ modified to contain limited additions of carbon, and zirconia containing limited additions of lanthana or ytterbia oxide. Observations made with cross-sections through the TBC's eroded at high temperatures suggested that multiple mechanisms of material removal were occurring and influenced by particle size, velocity, temperature, and material. The mechanisms were distinguished by the time scales for stress wave transit relative to those for plastic deformation, and were able to be described in terms of different domains that also represent different observed failure modes. The typical impact failure mode was with particle impingement at about ninety degrees to the surfaces of TBC's on pin specimens, and on the leading edges of HPT blades. Impact resistance can be estimated with the following equation:

$$I = \Gamma_{TBC} E_{YSZ}^{\alpha+1} / (\sigma^{tbc}_{y})^{2+\alpha-\beta}$$

From this formula, it can be seen that impact resistance (I) is increased with higher fracture toughness (Γ), higher elastic modulus (E), and lower yield strength (σ). Lower yield strengths allow plastic deformation to occur so that part of the impact energy can be absorbed by deformation before causing initiation of cracks.

Figure 3:
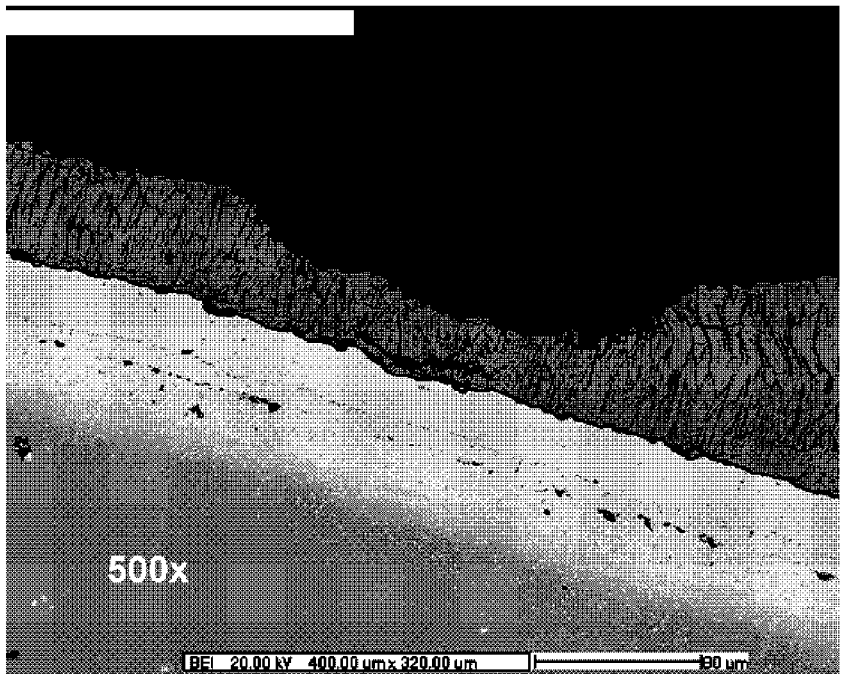
FIGS. 3 and 4 are scanned images of prior art thermal barrier coatings that have suffered spallation from impact damage.
Figure 4:
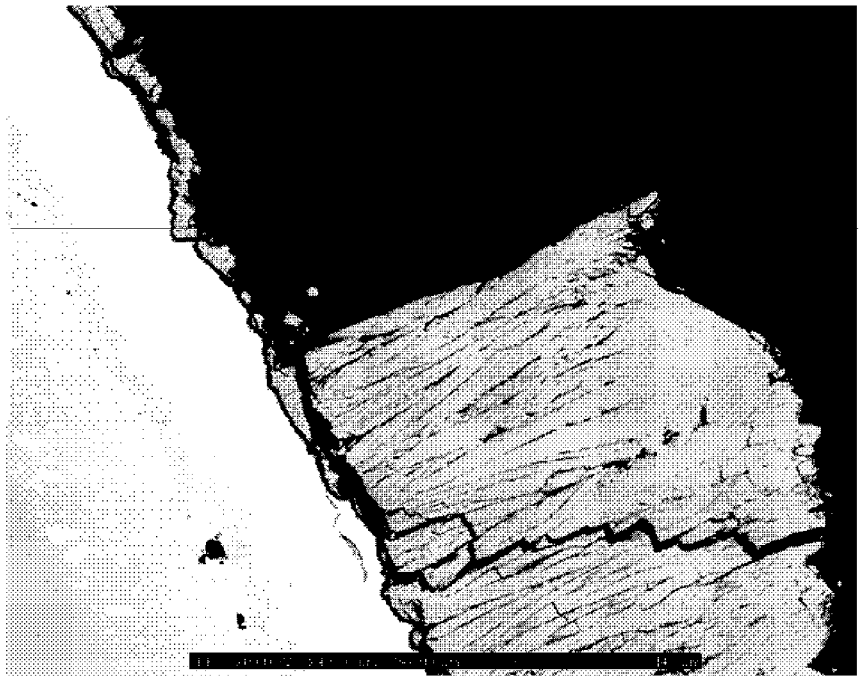

The above investigation and analysis illustrated that an important aspect of the impact failure mode is that material removal does not occur in a gradual fashion, as is the case with erosion. Instead, cracks propagate to the interface between the bond coat and TBC, where spallation occurs as seen in FIGS. 3 and 4. Final delamination was observed to typically occur about twelve micrometers from the bond coat-TBC interface. It was also observed that periodically located horizontal cracks were present in the TBC's at distances of about 80, 40, 24, and 12 micrometers from the bond coat-TBC interface. From FIG. 3, it can be seen that some TBC's detached in tiers at these subsurface locations. From these observations, it was concluded that improved impact resistance could be achieved with the dense inner region 38 located immediately adjacent the bond coat 24, and that impact resistance can be further improved with additional dense interior regions periodically located between the inner region 38 and the surface of the TBC 26, as described above.

While the invention has been described in terms of a preferred embodiment, it is apparent that other forms could be adopted by one skilled in the art. Accordingly, the scope of the invention is to be limited only by the following claims.

What is claimed is:

1. A thermal barrier coating comprising a first coating portion on at least a first surface portion of a component, the first coating portion being formed of a ceramic material to have an inner region and an outer region overlying the inner region, the first coating portion having a columnar microstructure whereby the inner and outer regions comprise columns of the ceramic material, the columns of the inner region being more closely spaced than the columns of the outer region so that the inner region of the first coating portion is denser than the outer region of the first coating portion and the outer region is more porous than inner region.

2. A thermal barrier coating according to claim 1, wherein the ceramic material within the inner region has a porosity level of less than 20 percent by volume.

3. A thermal barrier coating according to claim 1, wherein the ceramic material within the inner region has a crystallographic texture.

4. A thermal barrier coating according to claim 1, wherein the ceramic material within the outer region has a porosity level of at least 20 percent by volume.

5. A thermal barrier coating according to claim 1, wherein the thermal barrier coating further comprises a second coating portion on a second surface portion of the component so as not to overlie the first coating portion, the second coating portion being formed of the ceramic material to have an inner region and an outer region overlying the inner region, the second coating portion having a columnar microstructure whereby the inner and outer regions thereof comprise columns of the ceramic material, the columns of the outer region of the second coating portion being more closely spaced than the columns of the inner region of the second coating portion so that the outer region of the second coating portion is denser than the inner region of the second coating portion, resulting in the first coating portion being more impact resistant than the second coating portion and the second coating portion being more erosion resistant than the first coating portion.

6. A thermal barrier coating according to claim 5, wherein the component is a hot gas path component of a gas turbine engine, the first surface portion of the component is a leading edge of the component, and the second surface portion of the component is a concave surface of the component.

7. A thermal barrier coating according to claim 5, wherein the thermal barrier coating further comprises a third coating portion on a third surface portion of the component so as not to overlie the first and second coating portions, the third coating portion is formed of the ceramic material and is thinner than the first and second coating portions.

8. A thermal barrier coating according to claim 7, wherein the third coating portion is a continuum of the outer region of the first coating portion and thereby has a columnar microstructure comprising columns of the ceramic material, the columns of the inner region of the first coating portion are more closely spaced than the columns of the third coating portion, and the inner region of the first coating portion is denser than the third coating portion.

9. A thermal barrier coating according to claim 8, wherein the third coating portion is a single layer.

10. A thermal barrier coating according to claim 8, wherein the third coating portion is a continuum of the inner region of the second coating portion.

11. A thermal barrier coating according to claim 1, wherein the first coating portion further has first and second interior regions between the inner and outer regions, the first interior region being adjacent the inner region and comprising columns of the ceramic material that are more widely spaced than the columns of the inner region so that the first interior region is less dense than the inner region, the second interior region being adjacent the outer region and comprising columns of the ceramic material that are more closely spaced than the columns of the first interior region so that the second interior region is denser than the first interior region.

12. A thermal barrier coating according to claim 1, wherein the ceramic material within the inner and outer regions has a substantially uniform composition.

13. A thermal barrier coating according to claim 1, wherein the ceramic material consists essentially of zirconia stabilized by yttria.

14. A thermal barrier coating according to claim 13, wherein the inner region consists essentially of zirconia stabilized by less than six weight percent yttria, and the outer region consists essentially of zirconia stabilized by more than six weight percent yttria.

15. A thermal barrier coating according to claim 1, wherein the inner and outer regions are not discrete layers and are not separated by a distinct interface.

* * * * *

UNITED STATES PATENT AND TRADEMARK OFFICE

CERTIFICATE OF CORRECTION

PATENT NO. : 7,597,966 B2
APPLICATION NO. : 11/160164
DATED : October 6, 2009
INVENTOR(S) : Spitsberg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 839 days.

Signed and Sealed this

Twenty-eighth Day of September, 2010

David J. Kappos

David J. Kappos
*Director of the United States Patent and Trademark Office*